US007722419B1

(12) United States Patent
Wood

(10) Patent No.: US 7,722,419 B1
(45) Date of Patent: May 25, 2010

(54) DIVING PLATFORM

(76) Inventor: Harry A. Wood, 6432 95th St. NE., Lake Stevens, WA (US) 98258-9475

( * ) Notice: Subject to any disclaimer, the term of this patent is extended or adjusted under 35 U.S.C. 154(b) by 151 days.

(21) Appl. No.: 11/952,700

(22) Filed: Dec. 7, 2007

Related U.S. Application Data

(60) Provisional application No. 60/895,377, filed on Mar. 16, 2007.

(51) Int. Cl.
*B63B 22/26* (2006.01)

(52) U.S. Cl. ..... 441/40; 441/43

(58) Field of Classification Search ..... 441/67, 441/35, 40, 43; 114/346
See application file for complete search history.

(56) References Cited

U.S. PATENT DOCUMENTS

| | | | | |
|---|---|---|---|---|
| 1,390,935 | A * | 9/1921 | Stewart | 441/35 |
| 2,917,755 | A | 12/1959 | Peck | |
| 3,125,339 | A * | 3/1964 | Nielsen | 472/13 |
| 3,652,090 | A | 3/1972 | Semmens | |
| 3,871,042 | A * | 3/1975 | Farmer | 114/346 |
| 3,950,808 | A * | 4/1976 | Sorenson | 441/67 |
| 4,123,813 | A | 11/1978 | Adams | |
| 4,138,752 | A | 2/1979 | Dickson | |
| 4,366,963 | A * | 1/1983 | Reeves et al. | 280/18.1 |
| 4,939,510 | A | 7/1990 | Masheff | |
| 5,085,431 | A * | 2/1992 | McGuire | 473/386 |
| 5,141,458 | A | 8/1992 | Church | |
| 5,342,229 | A | 8/1994 | Whitt | |
| 5,369,796 | A | 11/1994 | Kung | |
| 5,516,316 | A * | 5/1996 | Rumminger | 441/1 |
| 5,640,922 | A | 6/1997 | Feldkamp | |
| 6,273,773 | B1 | 8/2001 | Bourke | |

OTHER PUBLICATIONS

Ebay listing of Flag-N-Float, Apr. 17, 2007.

* cited by examiner

*Primary Examiner*—Stephen Avila
(74) *Attorney, Agent, or Firm*—Dwayne E. Rogge; Hughes Law Firm, PLLC

(57) ABSTRACT

The subject of this disclosure relates to a diving apparatus and a method for marking a diver's' location. The disclosure provides a receptacle for diving equipment which is configured to float upon the surface of the water and optionally support a flag and pole to mark the diver's relative position underwater. An anchoring system is also disclosed coupling the apparatus to the sea floor or river bottom to maintain position of the apparatus in the general location of the diver. The apparatus further includes a perimeter ring handle, a receptacle for storing equipment, and a method for supporting a diver.

20 Claims, 7 Drawing Sheets

DIVING PLATFORM

RELATED APPLICATIONS

This application claims priority benefit of U.S. Provisional Ser. No. 60/895,377, filed Mar. 16, 2007.

BACKGROUND OF THE DISCLOSURE a) Field of the Disclosure

This disclosure relates to the field of diving apparatuses. In particular, this disclosure relates to an apparatus and a method for marking a diver's location, and providing a receptacle for diving equipment. A perimeter support handle is also disclosed, to support the diver when resting at the water's surface. The apparatus in one form is a floating device, configured with a receptacle for equipment, optional receptacle for a dive flag, and a device and method for attaching to an anchoring system.

b) Background Art

U.S. Pat. No. 2,917,755 (Peck) discloses a ring-shaped flotation device configured with an anchoring apparatus and furthermore configured to hold a lantern above the surface of the water for night fishing. FIG. 1 shows in detail how this is accomplished. The configuration of the central portion of this patent is specifically designed to retain a lantern.

U.S. Pat. No. 6,273,773 (Bourke) discloses a dive buoy dry box assembly. This patent includes several elements not including the counterweight portion 14 and a sealed dry box portion 16. A great deal of this patent is directed at the means by which the anchor line is spooled from and retracted back in to the ring portion 12. While this patent does disclose a floating apparatus for holding materials while diving and further include an upright diving flag. This reference is very explicit that this is a place to store items such that they will stay dry.

U.S. Pat. No. 4,123,813 (Adams) discloses a float and flag assembly for use by divers. This patent discloses a ring shaped flotation having an upright dive flag and a very shallow portion on the upper surface this portion is shallow U.S. Pat. No. 5,640,922 (Feldkamp et al.) discloses a hands-free dive flag connector wherein a ring flotation is coupled to an upright dive flag and is furthermore connected by way of a recoiling line to a diver such that the upright dive flag follows along on the surface above the diver in action.

U.S. Pat. No. 5,369,796 (Kung) discloses a floating sound system for use in a swimming pool or the like. The radio portion of the patent is fitted with threads, such that it screws into a central portion of the flotation device.

U.S. Pat. No. 5,342,229 (Whitt) discloses an anchor organization for mounting a float tube to the bottom surface and associated body of water. This patent discloses a way to anchor a ring float to the bottom of the body of water of varying depths. This operates similar to a kite reel.

U.S. Pat. No. 5,141,458 (Church) discloses a marker buoy having an inflatable portion such that the inflatable portion can be deflated when it is not desired that the buoy portion maintain on the surface of the water or for storage. This patent operates in the same manner as the U.S. Pat. No. 5,640,922 previously discussed.

U.S. Pat. No. 4,138,752 (Dickson) discloses a small wave-following buoy having a floating device and an upright portion for communications and a subsurface portion used for balance.

U.S. Pat. No. 3,939,510 (Curd) discloses an essentially all plastic lightweight buoy. This patent is not a ring shaped device. It can be circular or square in configuration. It has an upright portion for lighted channel markers or the like. Neither the addition of an upright dive flag, a peripheral ring handle portion, a central storage portion, nor an auger type anchor system is disclosed.

U.S. Pat. No. 3,652,090 (Semmens) discloses a recreational device comprising a generally bowl-shaped base.

SUMMARY OF THE DISCLOSURE

In the sport and business of underwater diving it is often desired to have a support apparatus on the surface of the water which is capable of marking the general location of the diver to boaters and other users for safety. It is further desired to have a device to operate as a receptacle for diving equipment not always needed underwater, or small items found underwater which the diver wishes to keep, such as shells or artifacts. At times it is desired that such a surface marker would float along the current with the diver, and at other times it may be desirable for the surface marker to be temporarily fixed to the seafloor or river bottom such that the diver can remain underwater within the general location of the anchoring system and not be concerned about the marker floating away. The apparatus of this disclosure in one form encompasses all of these aspects.

Thus, disclosed herein is a diving apparatus having in combination a buoyant member, a frame, a perimeter hand support, a containment structure, and optionally an apparatus for supporting a flagpole and dive flag. The buoyant member as discussed for ease of understanding will have an inner surface defining a central region and an outer perimeter surface. The frame is coupled to the buoyant member, and in one form this is accomplished by a plurality of frames support members wrapping substantially around the buoyant member to maintain its relative position therewith. Cord members, such as ropes, can also be utilized to secure the buoyant member to the frame members. A perimeter hand support is optionally coupled to the frame and supported at a distance from the buoyant member such that a diver can grasp the entire hand support and still utilize the buoyant location of the buoyant member. A containment structure is disposed within the previously discussed central region and aids the diver in containing elements that are required on the water but not necessarily on the person of the diver at all times. It may be desired that the containment structure is not entirely enclosed such that the diver would be able to place items within the containment structure without having to fuss about with latches or hatches. If an inflatable buoyant member is utilized, it will be desirable to not puncture the inflatable buoyant member thus releasing its buoyant support. It may be desired to provide a canvas-like material covering for the inflatable buoyant member to maintain its shape and further protect the surface of the inflatable point member. Indicia such as a dive flag, a red cross indicating first aid, owner's information such as address and phone number, or advertising indicia may be disposed upon the surface of the canvas-like covering, for example by embroidery. If a rigid or hard foam or optionally enclosed aluminum chamber is utilized for the buoyant member, it may also be desirable that the surface of the buoyant member not be compromised in the attachment of the frame. It may also be desired to have coverings of different colors to indicate different dive groups. For example, green coverings could indicate tech divers, while red tubes could indicate sport divers.

Holes in the surface allow some portion of water therein and tend to speed up the decomposition of the interior portion. As the containment structure is a partially enclosed region, rain, waves, or water dripping from the diver upon placing elements therein would tend to add unnecessary weight to the apparatus. Therefore, a plurality of surfaces defining openings are included in the containment structure to allow such water and other liquids to pass therethrough. It may also be desirable to form a drain hole in the underside of the perimeter handle to keep water from being contained therein.

As earlier stated, it is often preferable for the diving apparatus to be maintained in a general location about the diver, and thus an anchoring system may be employed to maintain such positioning. This may be relative to the seafloor or river bottom or optionally may be in relation to the current. Many different anchoring systems are available including screw type, auger-style anchors, Bruce anchors, mushroom anchors, sea anchors and the like. Sea (or parachute) anchors would have the added benefit that if the diver wished to float along with the current the apparatus would follow generally with the diver, and would not be substantially affected by surface winds and wave action. These anchor systems may be coupled to the device by a rode which will be described in other parts of this disclosure. As the buoyant member may not be a rigid element, it may be desirable in one form to have the anchor system couple to the buoyant member at the containment structure or the frame. It may optionally be preferred to couple the anchor system to the perimeter hand support. The weakest points of an anchoring system are the ends where the rode is coupled at one end to the anchor and at the other end to the apparatus. Thus it may be preferable to have an attachment bar coupled to the containment structure configured to rotate, thus reducing the angle between the anchor rode and the containment structure. Present analysis indicates this will significantly increase the lifespan of the anchoring system at this connection point.

While buoyant members are common in many shapes and sizes, a ring buoy style point member is very common in the art of diving having a generally torroidal shape. As this specific arrangement is very common, it may be desirable to utilize such rigid buoyant members in this apparatus.

While the containment structure previously discussed may be coupled to the buoyant member via the frame, it may optionally be desired to couple the containment structure directly to the buoyant member. While there are many different variations of a method to couple the containment structure to the frame or the buoyant member, including screws, rivets etc., including welding, welding may often be the most desired means of coupling such members in an aquatic environment.

The buoyant member not only operates to contain elements used by the diver but also is utilized as a marker for boats and other safety regulations, the buoyant member may be painted in a color contrasting with the surface water. Blaze orange, red, and fluorescent yellow are very common colors for to increase the visibility of buoyant members. The colors listed above, and their functional equivalents, increase the visibility of the apparatus while in use as surface water often appears colored from a bright blue to a dark gray. It may also be preferable to contain a ring member, especially an inflatable inner-tube style apparatus, within a canvas-like cover. This canvas-like cover would have the additional benefit of being able to comprise embroidery or other markings to indicate ownership or the location of specific first-aid kits or divers.

To increase visibility of the apparatus to boaters and other users of that aquatic area, it may be desirable to include a pole receiver operatively configured to receive a flagpole. This flagpole may have on its terminal end a dive flag which is generally a red field with a white diagonal stripe. These dive flags are very common in the art, and in some areas are a legal necessity.

DESCRIPTION OF THE PREFERRED EMBODIMENTS

Figure 1:
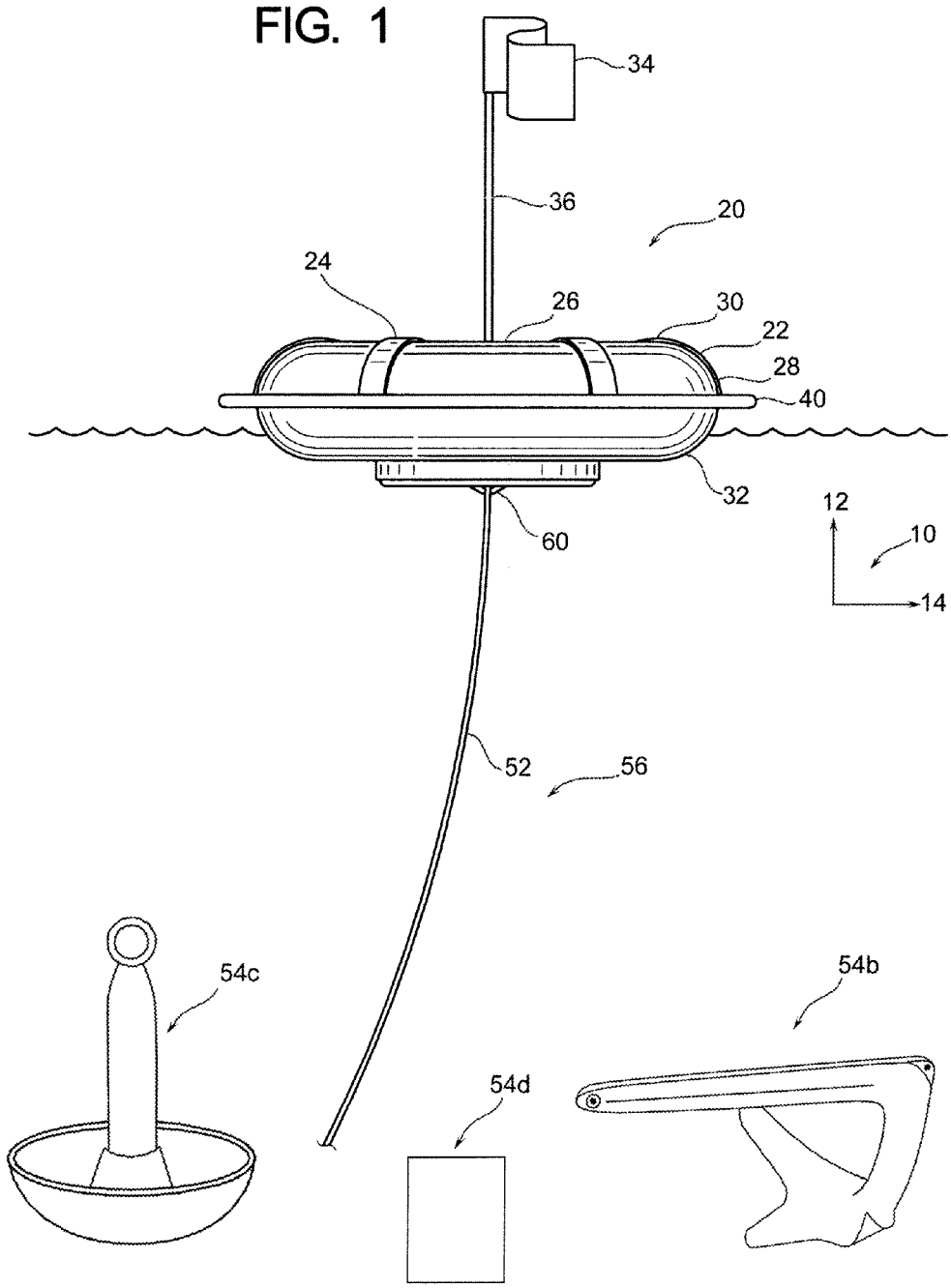
FIG. 1 shows a side view of one embodiment of the disclosure.

Discussed herein is a detailed description of one form of a buoyant apparatus 20. Before further discussing the main embodiment, an axes system 10 is defined as shown in FIG. 1 and comprises a vertical axis 12 and a radial axis 14. The radial axis generally extends radially outward from a center axis 16 shown in FIG. 2.

FIG. 1 shows a side view of the apparatus 20 which comprises a buoyant member 22 and a frame 24. The buoyant member 22 in one form is a toroidal shape, and in general, has a central region 26 with a center chamber and an outer portion 28. Further, as shown in FIG. 1, there is an upper surface 30, and a lower surface 32. In one form, the buoyant member 22 can be a conventional inflatable flotation device such as an inner tube or a rigid member Styrofoam flotation member.

Figure 2:
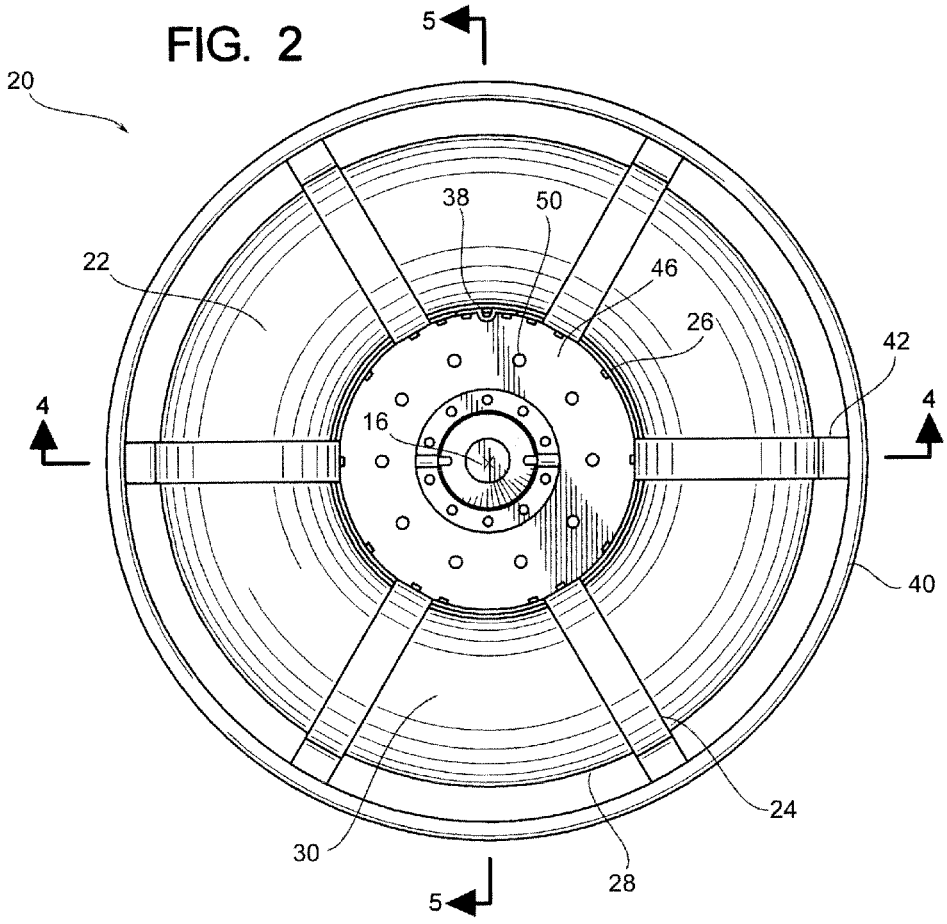
FIG. 2 shows a top view of one embodiment of the disclosure.
Figure 3:
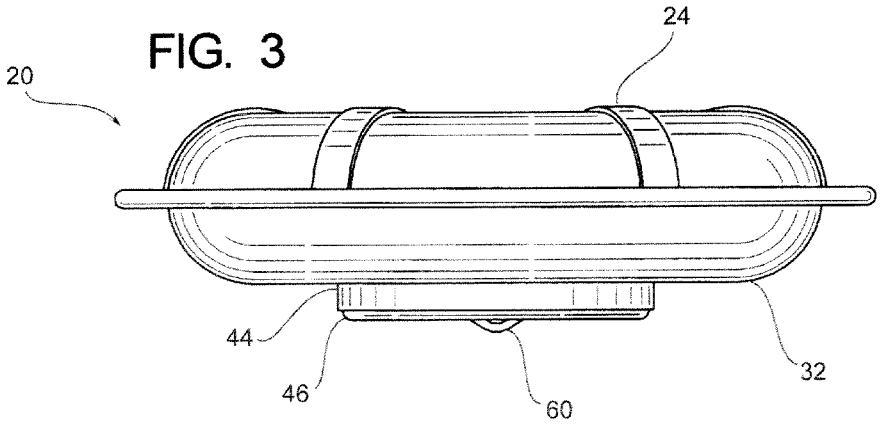
FIG. 3 shows a side view of one embodiment of the disclosure.

Referring to FIGS. 2 and 3, there is shown a side view of one configuration of the frame 24. Of course, in one form the frame 24 is comprised of a multitude of components, but it can alternatively be configured as a unitary structure, or comprised of a plurality of separate components which are fastened together by conventional methods. The frame 24 in one form comprises a plurality of elements: the perimeter hand support 40, frame supports 42, cylindrical member 44, and base 46. Such methods may include the use of aircraft "Huck" fasteners 48 for long-lasting durability.

While many different materials can be used to produce the frame 24, it may be desirable to make them out of plastic or metal. A specific form of the disclosure would be produced by using stainless steel to create the frame portion 24 of the apparatus 20. In this embodiment, the added benefit of a long-lasting frame portion which would not be compromised by a humid environment, or by salt water.

Figure 4:
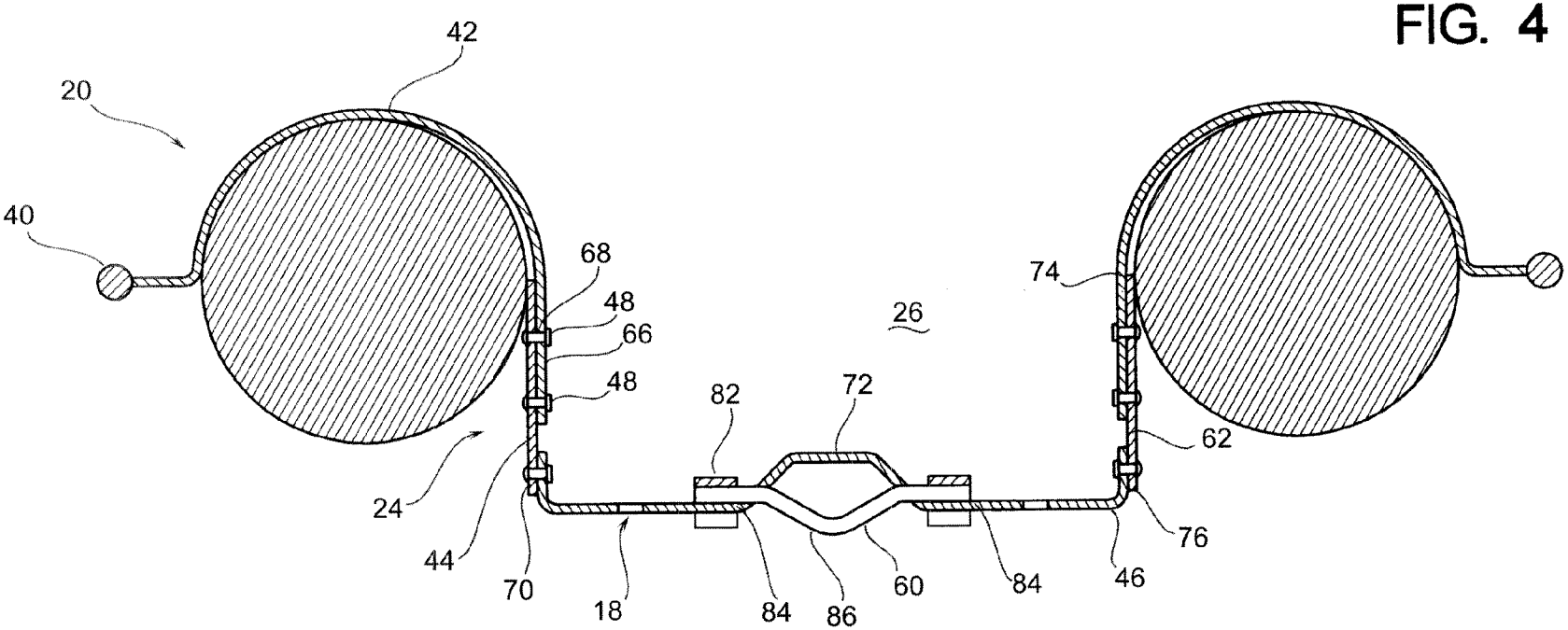
FIG. 4 shows a cross sectional view of one form of the disclosure along line 4 of FIG. 2.
Figure 6:
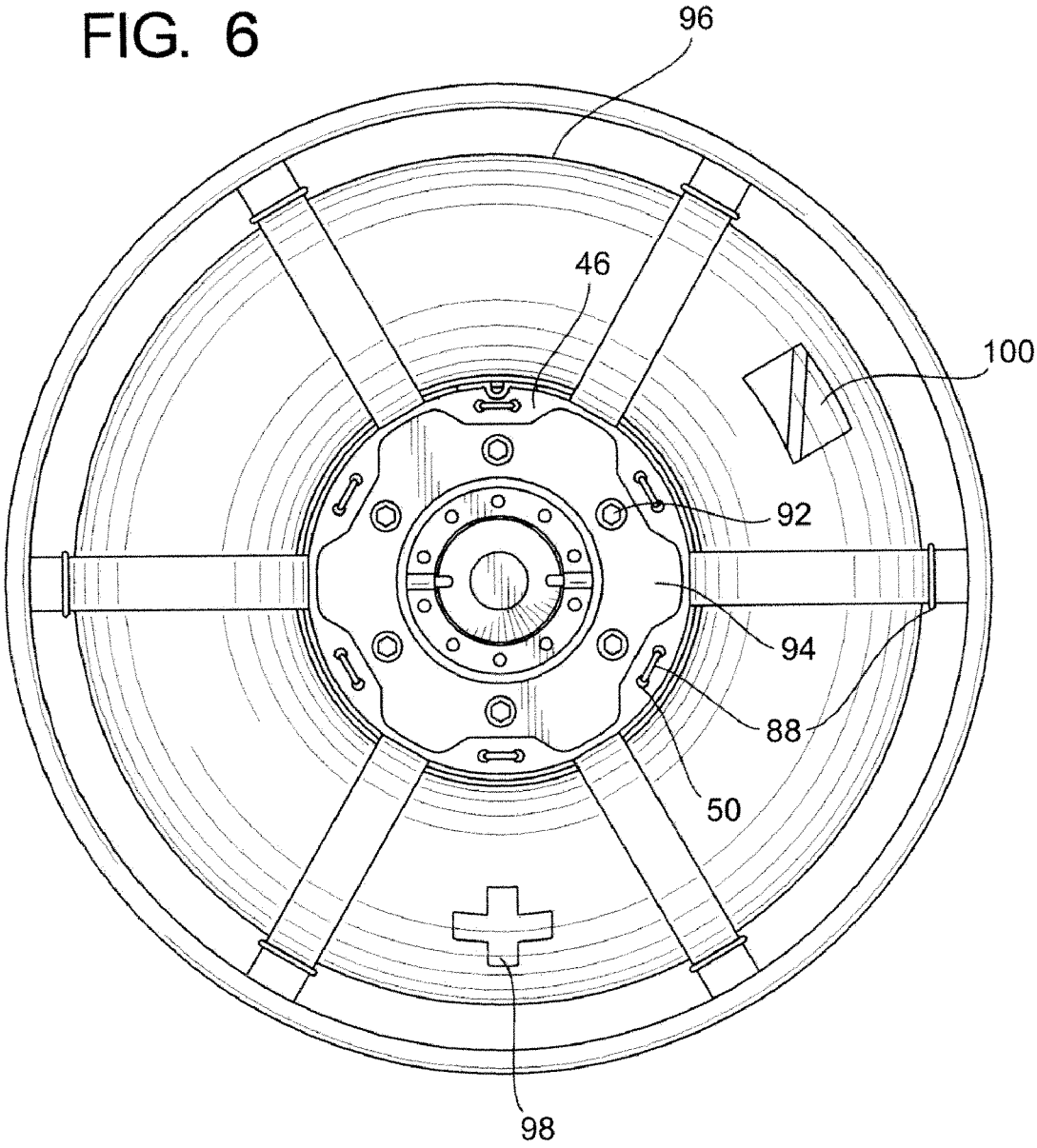
FIG. 6 shows a top view of another embodiment of the disclosure.

The perimeter hand support 40, in one form, is positioned around the outer portion 28 of the buoyant member 22, as shown in FIGS. 1 and 2. The frame is connected to a plurality of frame supports 42, which in one form extend radially inwardly and are attached to the cylindrical member 44. In one form, the frame supports 42 do not extend around the entire cross-sectional diameter of the buoyant member 22. While it may be advantageous to utilize frame supports which do completely surround the buoyant member, and therefore, securely maintain its position by utilizing frame support members which do not extend completely around the buoyant member, as shown in FIG. 4, the frame 24 may be removed from the buoyant member 22 for maintenance or replacement of either member. As shown in FIG. 6, a drain hole 86 may be disposed in the underside of the perimeter handle to allow water to drain therefrom. Furthermore, a cord member 88 may be utilized to couple the frame support 42 to the buoyant member 22. In one embodiment, the cord member 88 may be a rope, or similar apparatus, and may utilize the openings 50 to couple the buoyant member 22 to the base 46.

In one form, the cylindrical member 44 and the base 46 comprise a containment structure 18. The central region is operatively configured to hold gear and other material therein. In one form, this can be a sheet-metal structure which is pop riveted, or fastened by other means 48, or could be a plastic injection structure which is blow molded or configured by a plurality of manufacturing techniques. In the lower portion, surfaces defining openings indicated at 50 can be utilized to allow water or other liquids to pass through the central region 26 of the apparatus 20. FIG. 2 shows a top view of the unit where the plurality of frame supports 42 are shown, and the perimeter hand rail 40 is shown extending beyond the outer perimeter surface of the buoyant member 22. In this form, a diver or individual in the water can grasp the outer member easily without having any substantial obstructions. Further, it can be appreciated that divers could deposit their gear into the central region 26.

Figure 5:
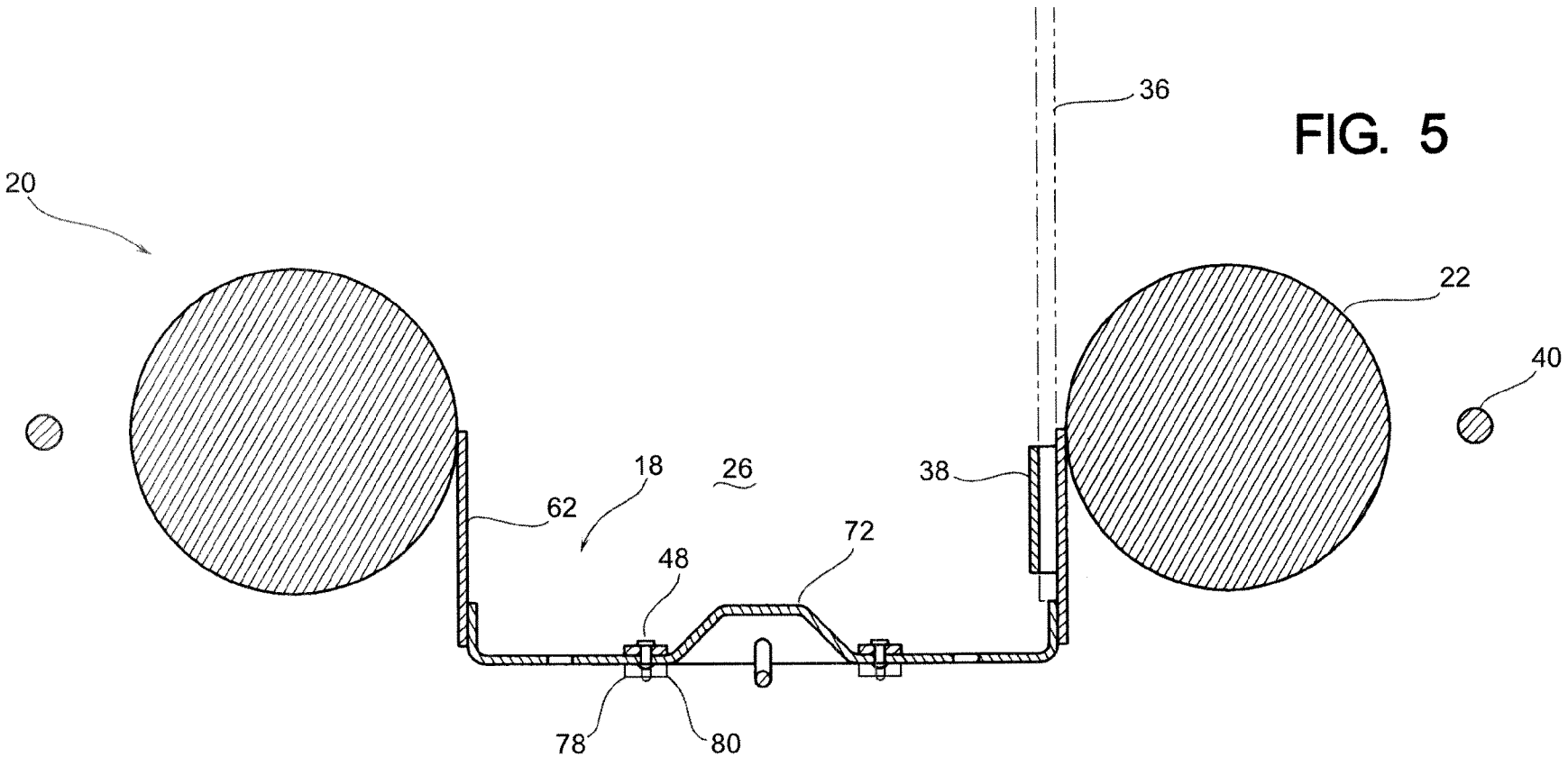
FIG. 5 shows a cross sectional view of one form of the disclosure along line 5 of FIG. 2.

For divers diving without a support vessel, a diver-down flag 34 (a red flag with a white diagonal stripe) should be floating in the surface in the divers' area. Boaters are legally bound to stay away from a diver-down flag. Thus, it is important to provide a method for suspending this flag above the surface of the water under which a diver or divers are operating. In one form of the disclosure a formed flag holder 38, as shown in FIG. 5, is disposed on the apparatus 20. While any number of such flag holders are possible, a formed flag holder 38 disposed on the inner surface of the connection ring 62 would keep the center of effort of the weight generated by the weight of the flag 34 and pole 36 near the center of the device, and would not significantly offset the balance of the apparatus 20. These flags 34 and poles 36 are very well-known in the art and thus are not shown in FIG. 5.

Referring now to FIG. 1, it can be seen that the connection member 60 in one form comprises a connection point where an anchor line 32 can be attached thereto. As shown in FIG. 4, the connection member 60 can be a separate element, and can be coupled to the base 46 by any number of fasteners, adhesive, or may be a unitary structure. In one form, a connection ring 62 is utilized. As shown in FIG. 4, the base 46 has a partially frusto conical surface 64 facing upward to supply enough room between the upper surface of the connection members 60 and the surface 64 to allow for a connector to fasten thereto. In one form, an augur-like anchor is screwed down to the bottom floor of the body of water and an anchor line connects this augur-like member to the buoyant apparatus 20 to anchor the apparatus 20 in a desired location.

An augur anchor 220 is disclosed in one form. The augur anchor 220 consists of several elements, the first being a ground penetrating portion 222, the second being a handle portion 224, and the third being a rode attachment portion 226. The ground penetrating portion has a first end 226 which may taper to a point while the second end 228 couples to a carrying handle 232. A plurality of blades 230 are disposed between the first end 226 and the second end 228 of the ground penetrating portion 222. These blades 230 act to maintain the position of the augur anchor 220 in the sea floor while in operation. The handle portion 224 consists of a plurality of driving handles 248 which, as can be seen, may be formed to provide excellent surface for driving the first end 226 into the sea floor while rotating the auger anchor 220. A plurality of extensions 246 are disclosed with couple the rode attachment portion 226 to the handle portion 224. As an alternative, the handle portion 224 may be coupled closer to the first end 226 perhaps at the carrying handle portion 232 or at the flared portion 234. The rode attachment portion 226 consists of a plurality of extensions 236 which form a partially enclosed loop ending in a plurality of downward protrusions 238. Each of the extensions 236 form an opening 242 permitting the passage of a portion of an anchor rode 252 as shown in FIG. 1. The downward protrusions 238 further act to keep the anchor rode 252 within the opening 242. A loop may be formed in the end of the anchor rode 252, and in the process of coupling to the anchor 220, the loop may pass between the plurality of extensions 236 into the opening 240 and then rotated through 90° to position it within the opening 242. This is similar to the action of a traditional lap link common in chain use.

Figure 8:
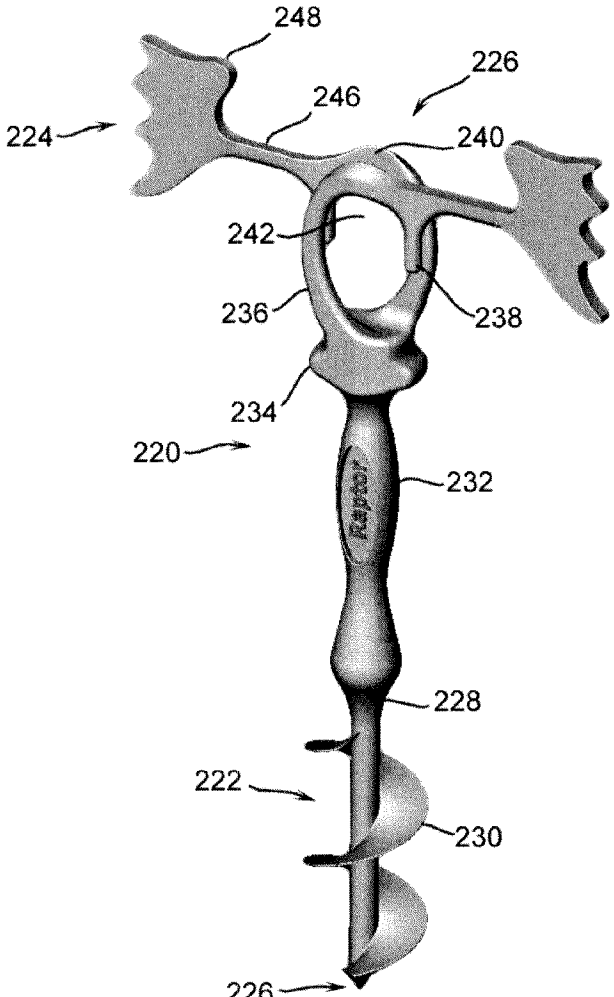
FIG. 8 is a perspective view of one form of auger anchor.

While an auger-style anchor 220 of FIG. 8 is one option, a Bruce anchor 54*b*, mushroom anchor 54*c*, or other anchoring devices would work just as well. Even a permanent fixture such as a sunken ship or reef may be utilized to maintain position of the apparatus. Referring now to FIG. 4, a form of the apparatus 20 is disclosed to better show the anchor attachment bar 60.

The frame 24 includes a plurality of frame supports 42 having on their first end a connection portion 66. The connection portion 66 may have a plurality of surfaces defining voids or connecting holes 68 which are configured to couple to the connection ring 62 by way of screws, rivets, or aircraft "Huck" fasteners 48 for long-lasting durability. The connection ring 62 in one form has a plurality of holes 70 which are configured to line up with holes 68 in the base 46. The connector 62 also has in one form a raised portion 72 which will be discussed later but can be easily seen in FIGS. 4 and 5. Furthermore, FIG. 4 shows a cutaway view of this part of the apparatus 20 in an assembled mode which shows fasteners 48.

FIG. 4 shows the formed flag holder 38 coupled to the connection ring 62. The pole receiver 38 is coupled to the connection ring 62 by way of fasteners as previously discussed. Referring back to FIG. 3, the next portion is a connection ring 62 which may be a unitary cylindrical element, and which may include a frusto conical surface, a partial hemisphere, or may be a flat unit formed to a cylinder. It is also conceived that the connection ring 62 may be a non-solid element. For example, the connection portion 66 of the frame supports 42 may couple directly to the base 46 or be formed of one unitary structure, and satisfy the same desires of this disclosure. The connection ring 62 has a top edge 74 and a bottom edge 76. The bottom edge 76 may have a plurality of holes 70 which are configured to accept fasteners 48 and couple to the base 46. The base 46 furthermore has openings 50 which allow water to pass through the base 46. This keeps the central region 26 from filling with water, and furthermore stabilizes the apparatus 20 when in use.

As shown in FIG. 5, the lower retaining ring 78 has a plurality of holes 80 which can be utilized to couple the lower retaining ring 78 to the base 46 supported by an upper retaining ring 82. The next portion, the anchor attachment 60, has a plurality of brace portions 84 configured to rotatably couple to the base 46 and be retained by the upper retaining ring 82, as shown in FIG. 4 and FIG. 2. The anchor attachment bar 60 is comprised of a brace portion 84 which rotatably couples to the apparatus 20, and includes a bent portion 86 configured to attach to an anchoring system 56. The anchoring system 56 comprises an anchor line 52, an anchor 54, and an anchor attachment bar 60. To make it easier to couple the anchoring system 56 to the apparatus 20, the base 46 may have a raised portion 72 forming an indent in the bottom of the apparatus 20, as shown in FIGS. 2, 4 and 5. This raised portion 72 may be formed as a portion of the base 46, or may be a separately formed element which is later coupled to the base 46. Optionally this raised portion 72 may be omitted forming a much larger void in the bottom of the base 46.

Figure 7:
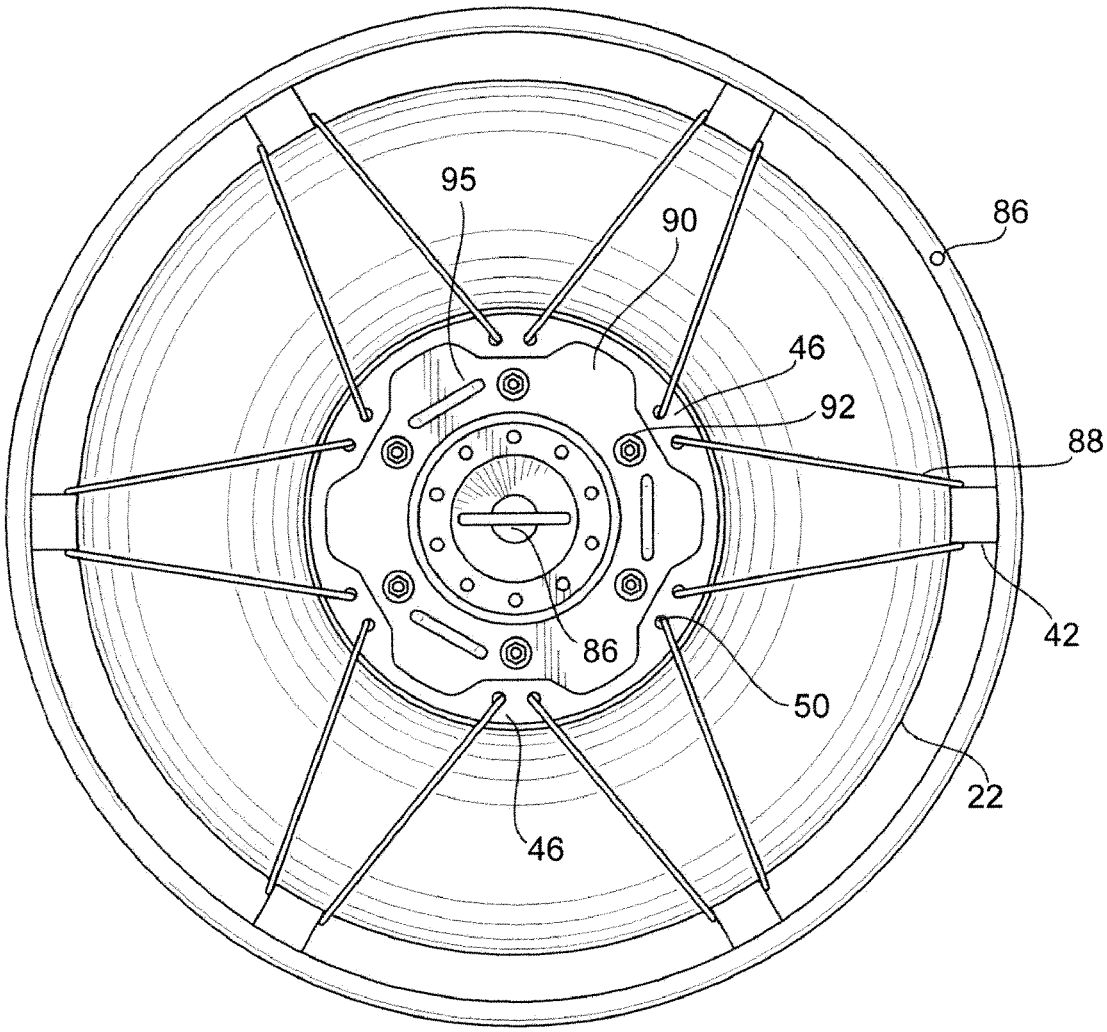
FIG. 7 shows a bottom view of another embodiment of the disclosure.

The base 46 may also have attached thereon an auxiliary plate 90. The auxiliary plate 90 may be connected to the base 46 by way of fasteners 92 or other methods, including adhesive and welding. The auxiliary plate 90 as shown in FIG. 7 may also have a doubling, or backing plate 94 as shown in FIG. 6. This backing plate 94 would form a very stable connection between the base 46 and the auxiliary plate 90 by way of the fasteners 92. A plurality of partial loops or rings 95 may also be disposed on the lower surface of the auxiliary plate 90. These rings 95 may be in the form of loops which form a stable attachment point for auxiliary items needing to be coupled to the underside of the apparatus when it is in use. The rings 95 may be welded to the auxiliary plate 90, or may in one form be bolted thereto. As shown in FIG. 7, a plurality of three rings 95 are shown; however, larger apparatuses may contain more rings. It is also possible to have fewer rings for smaller apparatuses, or for specialty operations. Using a standard truck tire inner-tube, for example, 250 pounds or more of chain or similar material may be suspended from these loops underwater with little or no difficulty. Additional SCUBA tanks could also be suspended at different depths to facilitate decompression of divers returning to the surface after a deep or prolonged dive.

Anchoring systems are very well-known in the art and generally consist of an anchor 54 which can either claw into the bottom of the body of water like a claw or Bruce 54*b* or auger 54*a*, or alternatively may comprise of a heavy object such as a cinderblock, concrete block, or other heavy object which need not penetrate the bottom of the body of water. The bottom of the body of water may be the sea floor, lake bottom, or river bottom. This anchor is then connected to a rode (anchor line 52) which in turn couples to the device to be anchored (in this case, the apparatus 20). The rode may also consist of a plurality of elements, such as with sailboats which commonly use a length of chain coupled to the boat, which is in turn is coupled to a rope, which is then coupled to the anchor. The apparatus 20 in one form utilizes a light weight rode, and a collapsible anchor or screw-auger-type anchor 54*d*, which would make the entire system very light and easy to transport to a diving location.

It may be desirable to have the apparatus configured in such a way that downward force exerted upon the perimeter handle by a diver fully equipped for diving will exert a force upon the perimeter handle 40 insufficient to overcome the upward force exerted by the buoyant member about a center of effort to submerge or to topple the apparatus. For example, a full-grown man wearing a wet suit in diving gear may have a wet weight exceeding 250 pounds. Thus, the buoyancy force of the buoyant member must exceed 250 pounds on that side of the center of effort. As another example, two divers each having a wet weight of 250 pounds exerting downward force upon the apparatus on opposite sides of the buoyant member would require at least 500 pounds of buoyancy to offset their weight and keep them afloat. This disregards the wet weight of any equipment contained within the containment structure, and the wet weight of the anchoring system.

While the apparatus may be configured in a wide range of sizes, one embodiment of the disclosure would have an overall diameter of between 24 and 48 inches, and a thickness of between 10 and 24 inches. The perimeter handle may be disposed such that a distance of between two and 6 inches separates the outer perimeter of the buoyancy member from the hand support. This would allow a diver wearing thick gloves, such as those made of neoprene, to fully grasp the perimeter handle. The perimeter handle may be a tube-like element, having a cross-sectional diameter of between three quarters and two inches.

The perimeter handle 40 may optionally be a sectional handle meaning one or more handles may be coupled to the frame 24. A plurality of handles may be utilized so that one or more divers can get one or more hand attached to the apparatus 20, thus supporting them in the water.

While the present invention is illustrated by description of several embodiments and while the illustrative embodiments are described in detail, it is not the intention of the applicant to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A diving apparatus comprising:

a. a buoyant member having an inner surface defining a central region, and an outer perimeter surface;

b. a rigid frame coupled to the buoyant member;

c. a rigid perimeter hand support coupled to the frame substantially at a distance from the buoyant member;

d. wherein the frame is frictionally coupled to the buoyant member;

e. at least one rigid, frame support coupled to the perimeter hand support and extending radially inward to couple to the frame, f. a rigid containment structure disposed within the central region; and g. wherein the containment structure is not entirely enclosed.

2. The diving apparatus of claim 1, wherein the containment structure is configured to substantially contain diving equipment and the like within the central region.

3. The diving apparatus of claim 2, wherein the containment structure further comprises surfaces defining openings configured to permit liquid to pass through the containment structure.

4. The diving apparatus of claim 1, further comprising an anchor system configured to interoperate with the frame.

5. The diving apparatus of claim 4, wherein the anchor system includes an augur-style anchor operatively configured to be coupled via a rode to the frame.

6. The diving apparatus of claim 5, wherein the anchor system is operatively configured to be coupled to the frame at the containment structure.

7. The diving apparatus of claim 6, wherein the anchor system is coupled to the frame by way of an anchor attachment bar which is positionably coupled to the containment structure.

8. The diving apparatus of claim 1, wherein the buoyant member is substantially toroidal in shape.

9. The diving apparatus of claim 1, wherein the buoyant member is comprised of a rigid material.

10. The diving apparatus of claim 1, wherein the containment structure is coupled to the buoyant member via the frame.

11. The diving apparatus of claim 10, wherein the containment structure is coupled to the frame via welds.

12. The diving apparatus of claim 1, wherein the buoyant member further comprises a covering comprising a surface color contrasting with surface water.

13. The diving apparatus of claim 12, wherein the buoyant member further comprises a canvas-like covering.

14. The diving apparatus of claim 1, further including a pole receiver operatively configured to receive a flagpole.

15. A diving apparatus comprising a. a. a rigid, frame having an inner surface defining a containment structure, b. wherein the frame is operatively configured to frictionally couple to a buoyant member, c. a plurality of radially extending rigid frame supports having ends coupled to the frame on a first end, d. a rigid perimeter hand support coupled to the frame supports at the frame supports second end;

e. wherein the rigid frame supports maintain the hand support at least a minimum distance from the frame; and f. wherein the containment structure is not entirely enclosed.

16. The diving apparatus of claim 15, further comprising an anchoring system.

17. The diving apparatus of claim 15, further comprising a dive flagpole receiver.

18. The diving apparatus of claim 15, further comprising a buoyant member configured to interoperate with the frame.

19. The diving apparatus of claim 18, wherein the buoyant member is a rigid member in a substantially toroidal shape.

20. A method of providing a diving platform on the surface of a body of water for divers to place items thereon, the method comprising:

a. retrieving a rigid frame member having an inner surface defining a containment region, the frame member having a plurality of rigid frame supports attached to an inner frame portion and to an outer rigid frame portion, b. having the outer rigid frame portion operate as a rigid perimeter handle member providing a grasping region for divers to grasp while in the water, c. having a flotation member operatively connected within the containment region of the rigid frame member, the flotation member having sufficient buoyancy to provide flotation for the rigid frame member, d. wherein the outer rigid frame portion is frictionally coupled to the buoyant member through at least one radially extending member;

e. providing the inner frame portion of the rigid frame member having a containment surface which is positioned in a central open region of a flotation member and is configured to hold the items thereon when the diving platform is in operation on the body of water, f. providing the ability to remove the flotation member from the rigid frame member where the flotation member can act independently as a flotation device.

* * * * *